US010582830B2

(12) United States Patent
Fasson et al.

(10) Patent No.: US 10,582,830 B2
(45) Date of Patent: Mar. 10, 2020

(54) HANDHELD RETRACTABLE CLEANING SPRAYER

(71) Applicant: Rita Szutenbach Fasson, Littleton, CO (US)

(72) Inventors: Rita Szutenbach Fasson, Littleton, CO (US); Steven Anthony Szutenbach, Evergreen, CO (US)

(73) Assignees: Rita Fasson, Evergreen, CO (US); Steven Szutenbach, Evergreen, CO (US)

( * ) Notice: Subject to any disclaimer, the term of this patent is extended or adjusted under 35 U.S.C. 154(b) by 0 days.

(21) Appl. No.: 15/727,312

(22) Filed: Oct. 6, 2017

(65) Prior Publication Data

US 2019/0104917 A1 Apr. 11, 2019

(51) Int. Cl.

| | |
|---|---|
| ***A47L 17/04*** | (2006.01) |
| ***B05B 7/12*** | (2006.01) |
| ***E03C 1/04*** | (2006.01) |
| ***A47L 17/00*** | (2006.01) |
| ***E03C 1/08*** | (2006.01) |
| ***A47L 11/40*** | (2006.01) |

(52) U.S. Cl.

CPC ..... *A47L 17/04* (2013.01); *A47L 11/4088* (2013.01); *A47L 17/00* (2013.01); *B05B 7/12* (2013.01); *E03C 1/0404* (2013.01); *E03C 1/08* (2013.01); *E03C 2001/0415* (2013.01)

(58) Field of Classification Search

CPC ..... A47L 17/04; A47L 17/00; A47L 11/4088; B05B 7/12; B05B 17/04; E03C 1/0404; E03C 2001/0415

USPC ..... 4/678

See application file for complete search history.

(56) References Cited

U.S. PATENT DOCUMENTS

| | | | | |
|---|---|---|---|---|
| 6,419,166 | B1 * | 7/2002 | Brzezinski | A46B 11/066 222/395 |
| 6,785,915 | B1 * | 9/2004 | Daugherty | A61H 35/00 4/420.1 |
| 8,702,018 | B1 * | 4/2014 | Rivera | E03C 1/0408 239/310 |
| 9,433,281 | B1 * | 9/2016 | Barras | A46B 11/063 |
| 2003/0127537 | A1 * | 7/2003 | Wang | B05B 7/12 239/310 |

* cited by examiner

*Primary Examiner* — Huyen D Le

(74) *Attorney, Agent, or Firm* — Rita Fasson; Steven Szutenbach

(57) ABSTRACT

A device that combines a handheld retractable sprayer nozzle with an integrated soap/cleaning compartment for hot tubs, bathtubs, sinks, showers and other uses for residential, commercial, and industrial cleaning. The core elements are a nozzle with a rotating variable spray head, water selection knob, and distinctly, a compartment for tablets for soap, cleanser, etc. By using a self-contained closed system that eliminates additional suction hoses, containers, and multiple large soap containers this device will provide an easy to use product for end-users.

4 Claims, 6 Drawing Sheets

HAND HELD RETRACTABLE
NOZZLE SIDE VIEW EXTERIOR.

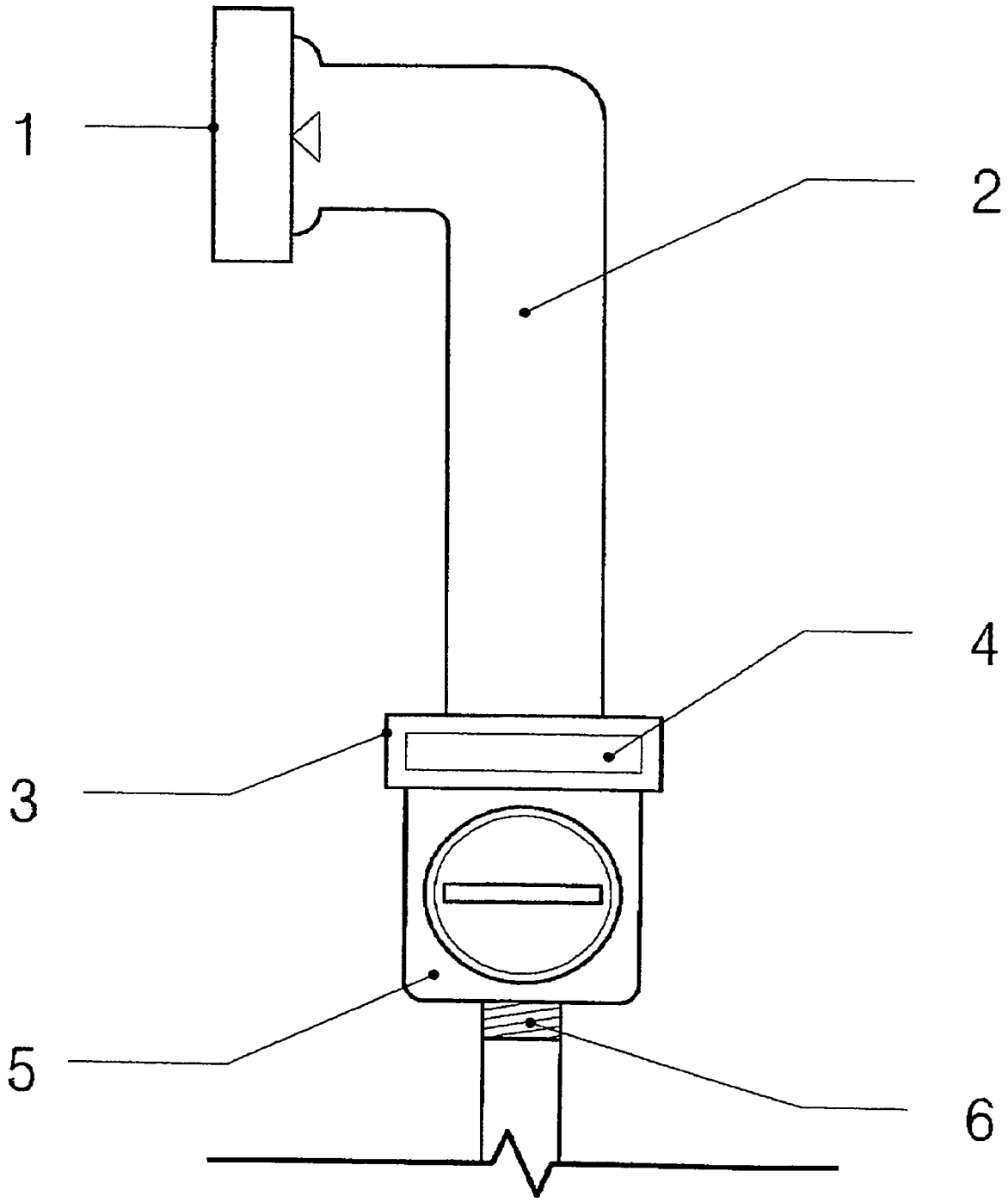
FIG.1: HAND HELD RETRACTABLE NOZZLE SIDE VIEW EXTERIOR.

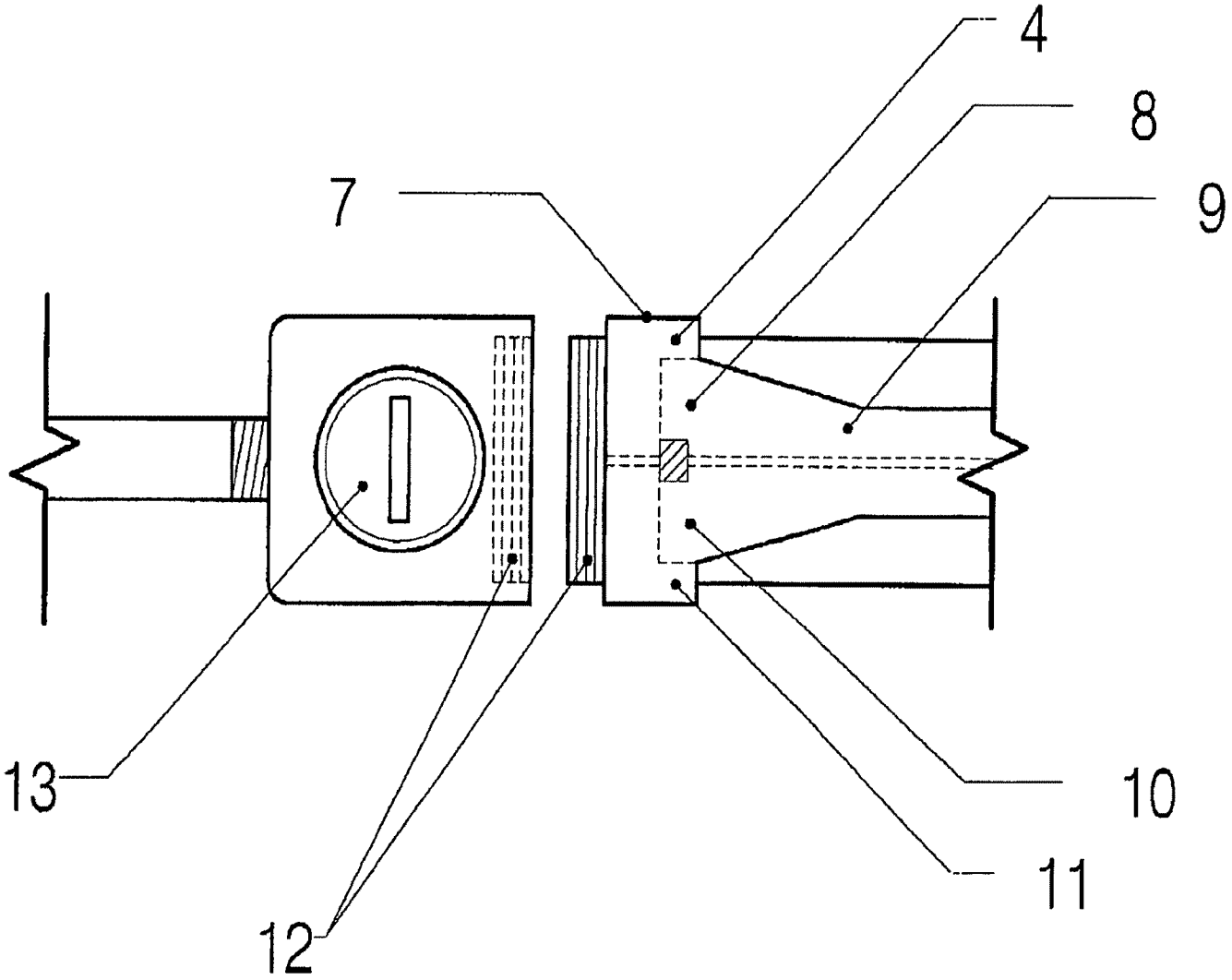
Fig. 1a Left side view of handheld retractable nozzle, water chamber splitter, and nozzle connection

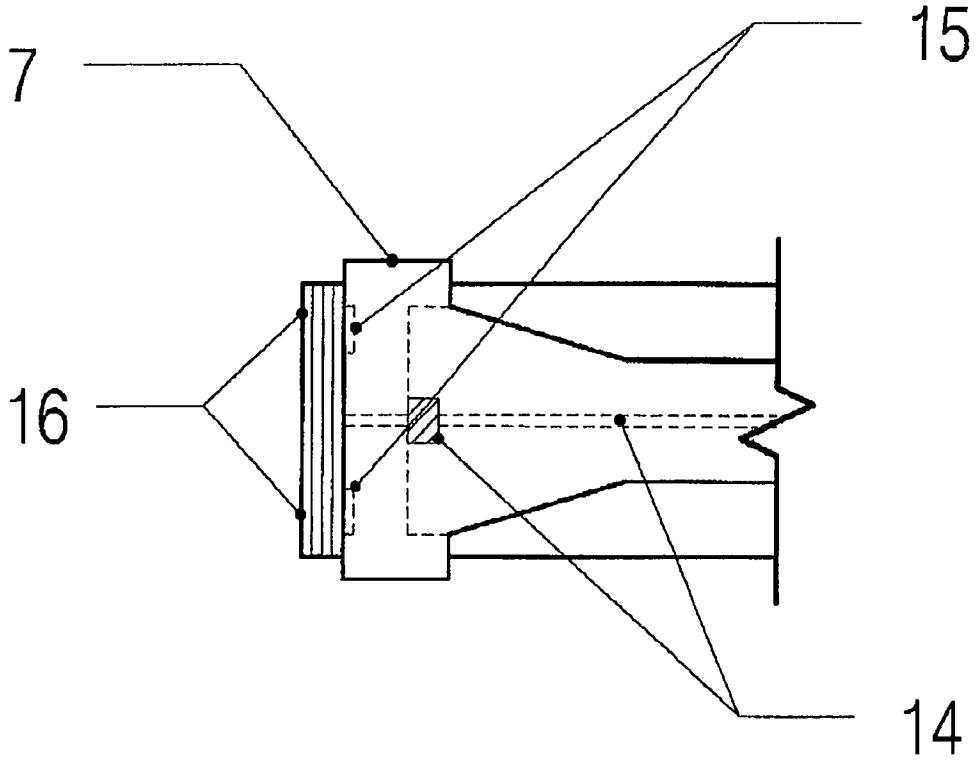
Fig. 2 Handhaeld retractable nozzle. Side view of water chamber splitter

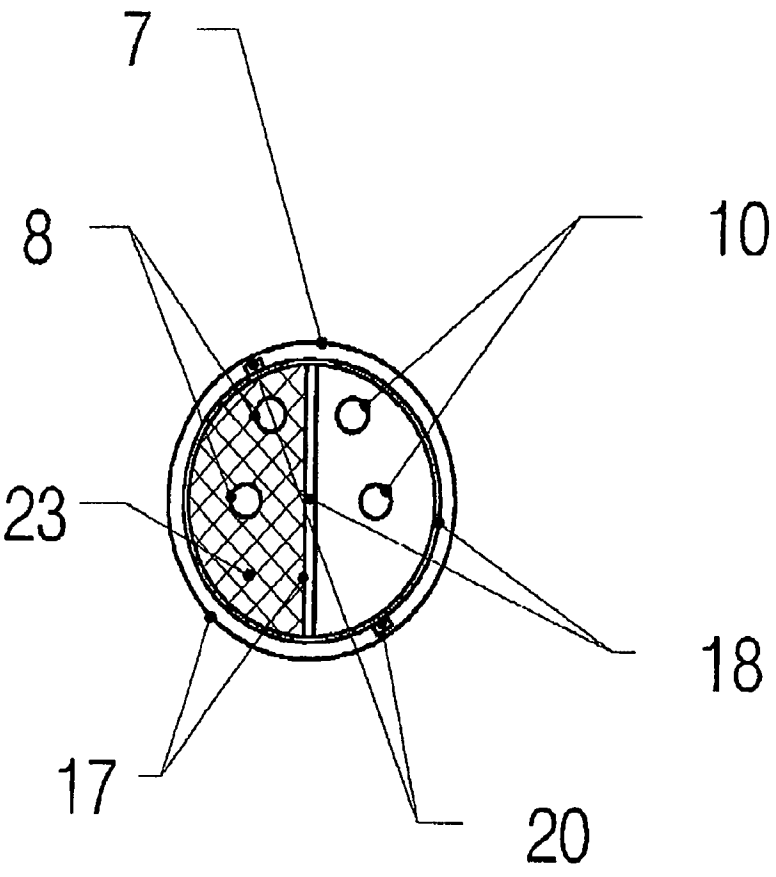
Fig. 2b: Bottom View of Nozzle Water Chamber Splitter
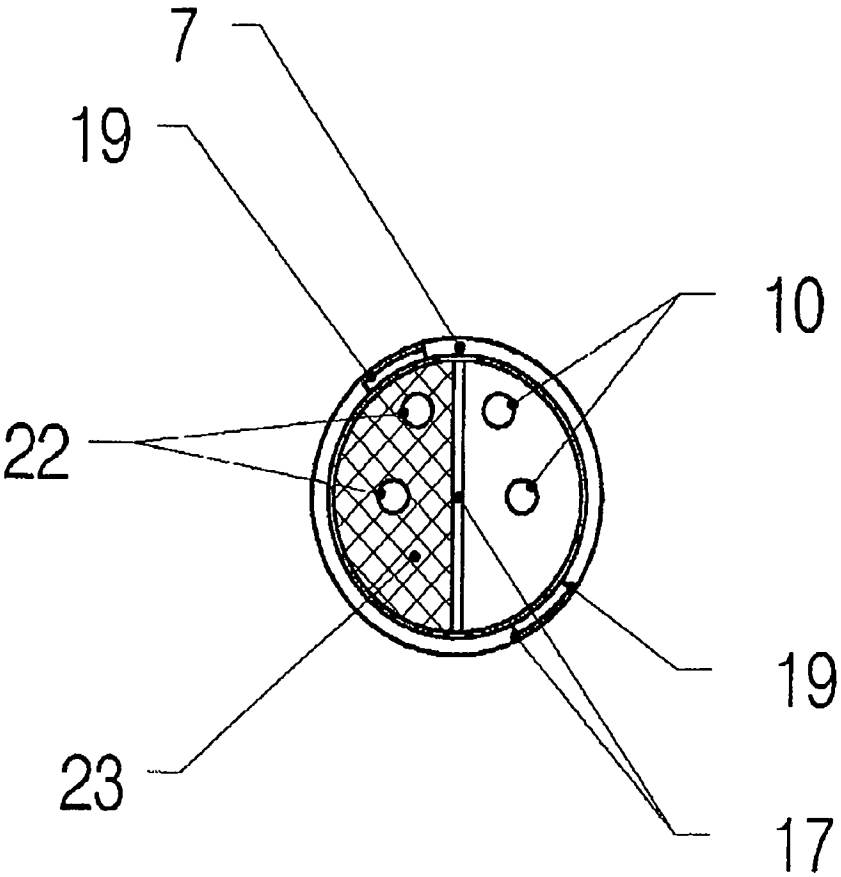
Fig. 2a: Top View of Ball Valve Assembly Water Chamber Splitter

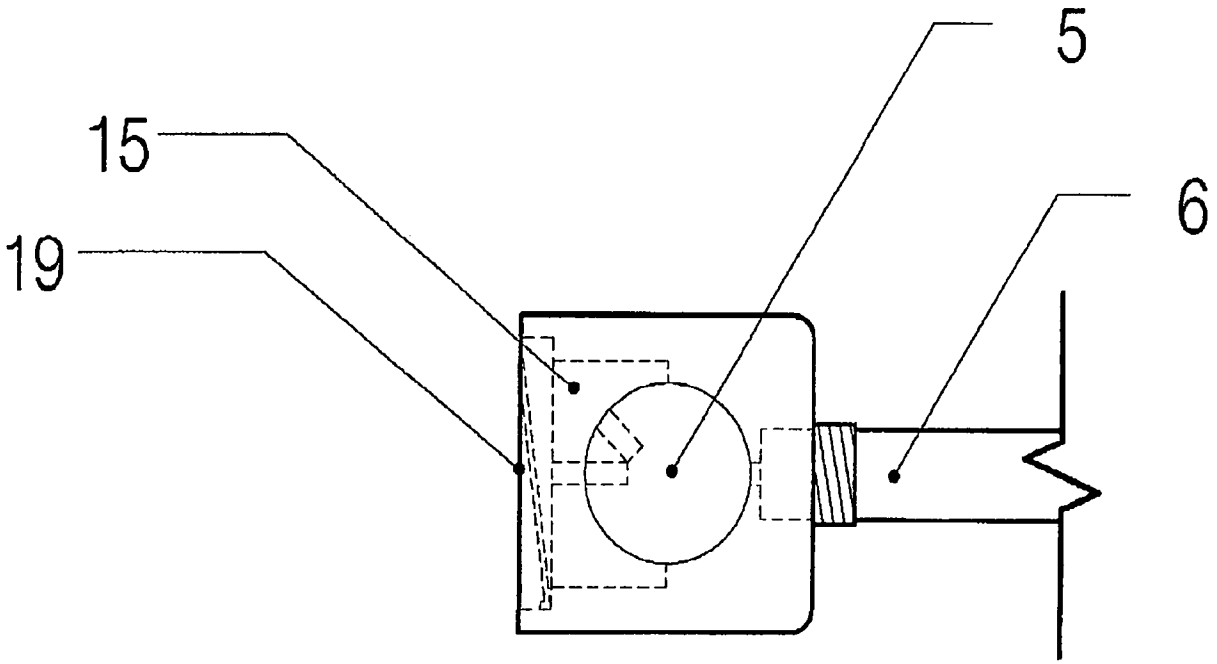
Fig. 3 Handheld retractable nozzle side view of 3-way ball valve assembly

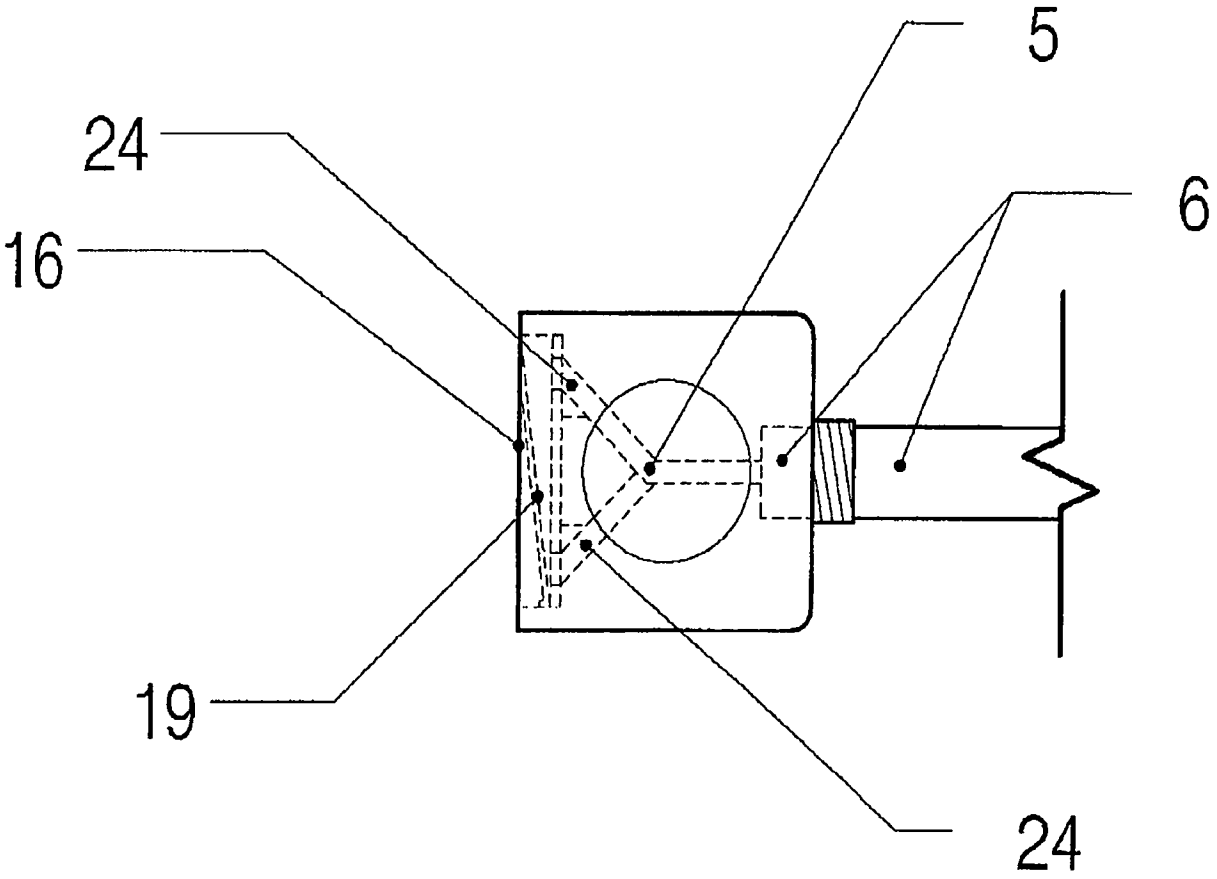
Fig. 3a: Right Side Cutaway View Of Ball Valve Assembly

HANDHELD RETRACTABLE CLEANING SPRAYER

CROSS-REFERENCE TO RELATED APPLICATIONS

"Not Applicable"

STATEMENT REGARDING FEDERALLY SPONSORED RESEARCH OR DEVELOPMENT

"Not Applicable"

THE NAMES OF THE PARTIES TO A JOINT RESEARCH AGREEMENT

"Not Applicable"

STATEMENT REGARDING PRIOR DISCLOSURES BY THE INVENTOR OR A JOINT INVENTOR

"Not Applicable"

BACKGROUND OF INVENTION

The present invention relates to handheld spray nozzles. With large residential and commercial basins or machinery it is often cumbersome for the user to clean and rinse the object or objects, usually requiring the wetting down of the surfaces to be cleaned, applying soap from a separate source (e.g. bucket and sponge, siphoned liquid soap, etc.) then rinsing. The Handheld Retractable Cleaning Sprayer uniquely provides an all-in-one device.

The invention includes an adjustable spray nozzle connected to a hose. The hose is connected to the inner plumbing of a basin or other clean water source. At the base of the nozzle, and the top of the hose, is a ball valve that provides selections of Soap, Off, and Rinse settings. Above the ball valve is the tablet holder. To operate the Handheld Retractable Cleaning Sprayer, the user selects the desired water source, soap or rinse, to get a flow of water. Turning the ball valve selector to the right or left will give options for water flow. The top of the nozzle has a turnstile mechanism and allows for different types of spray.

Field of the Invention

"Not Applicable"

Prior Art

Spray nozzles of all sorts that are similar have been used for many decades and are useful primarily as rinsing or watering devices. Examples found:

US 2010/0125946, Faucet Having Pull-out Spray Handle.

Uses the kitchen faucet to provide direct aeriated water flow. A second opening, in which the faucet body has an inner wall allows a mechanism to control the liquid flew through the faucet body. The invention is related to faucets including pull out sprayers for spraying a wide area at angles, particular with respect to such pull-out spraying faucets that are used for kitchen sink use.

US 2004/0211000, Sink faucet with integral liquid soap dispensing apparatus.

A manual or sensor type sink faucet for residential or commercial use, with an integral liquid soap dispensing system. A conduit extends internally through the faucet body from a remote supply of liquid soap. The conduit acts as a passage for the liquid soap to travel from the remote supply of liquid soap to outlet hole at the head of the faucet located directly over the sink bowl. The conduit can also be mounted externally to the faucet body and also dispense soap at the head of the faucet inside the sink bowl.

U.S. Pat. No. 5,906,319 Water/soap sprayer for kitchen faucets.

The main object of this invention is to provide a sensor or manual type sink faucet with an apparatus for dispensing liquid soap directly over the sink bowl. The apparatus can be mounted internally or externally to the sink faucet. Depending on the type of installation, the soap can be dispensed independently of or simultaneously with the water.

U.S. Pat. No. 3,718,149 Dish-Washer

In a dish-washing machine of the type having two separate washing zones in which delicate tableware and cooking utensils are respectively charged, there utensil washing zone and is operated as a result of rise of the washing temperature in the zone for the cooking utensils.

U.S. 3,770,205 Sprayer with Detergent or Chemical Additive Feed

A sprayer connectable to a hose and including a body having a compound four-position valve controlling a primary passageway and two sets of auxiliary passage ways. An antisiphon device attached to the body connects the hose to the primary passageway and terminates in a spray nozzle. The auxiliary passageways, shunting the primary passageway, include a common reservoir mounted on the underside of the body for containing either a liquid soap or detergent or pellets of a soluble chemical, such as a pesticide or plant food additive compound. The valve, operable by a finger lever, may be shifted from an "off" position where the main passageway is closed, to a "rinse" position where only the primary passageway is open to a "liquid" position where both the primary and a first set of auxiliary passageways are open, and to a "pellet" position where both the primary and second the auxilat of auxiliary passageways are open.

BRIEF SUMMARY OF INVENTION

Reference FIG. 1, the handheld retractable cleaning sprayer nozzle is attached by a flexible hose to the water source with the length determined by user requirements. The water input line connector 6 at the bottom of the nozzle, is adaptable to various connections as required for residential or industrial needs. The water flows from the water input line connector 6 through the 3-way ball valve assembly 5. Once an option is selected on the device, the water continues to flow through the tablet holder chamber 4. Water continues to flow through the main nozzle body 2 through the rotation nozzle 1, wherein, the user selects one of the multiple spray options: spray, stream, shower, mist, etc.

BRIEF DESCRIPTION OF THE DRAWINGS

FIG. 1 shows an exterior side view of the handheld retractable nozzle; FIG. 1*a* shows the left side view of the handheld retractable nozzle, water chamber splitter and nozzle connection;

FIG. 2 shows the side view of the bottom of the handheld retractable nozzle and water chamber splitter;

FIG. 2*a* shows the top view of the 3-way ball valve assembly water chamber splitter;

FIG. 2*b* shows the bottom view of nozzle water chamber splitter

FIG. 3 shows the handheld retractable nozzle side view of 3-way ball valve assembly; and FIG. 3*a* shows the right side cutaway view of 3-way ball valve assembly.

DETAILED DESCRIPTION OF THE INVENTION

The handheld retractable cleaning sprayer provides a tool for ease in cleaning large basins, mechanisms, large surfaces, spas, hot tubs, etc. In reference FIG. 1 and la this device is attached via a water input line connector 6 to a water source (plumbing, exterior faucet, etc.). This provides a flexible, easy to direct water stream for pre-rinse, cleaning, and rinsing. Above the water input line connector 6, is the 3-way ball valve assembly 5. This provides a single source of water for initial wetting, cleaning, and rinsing with the simple turning of the water selector knob 13. Choosing the option for cleaning, the water source flows through the tablet holder chamber 4. The tablet holder chamber 4 has an indented compartment to insert a tablet. Once the desired tablet solution is placed inside the compartment, the water input line connector 6, with the 3-way ball valve assembly 5, is re-attached to the main nozzle body 2 via the coupling 12. The detergent is applied as it flows through the nozzle water output channel 9.

In reference to FIGS. 2*a* and 2*b* the tablet chamber screens 23 are integrated in both tablet chambers 4 to hold the tablet in place and ensure consistent water flow around the tablet. The coupling quick connect/disconnect alignment pins 20 are inserted into the quick connect/disconnect receiving slot 19 as shown in FIG. 3. After turning the main nozzle body 2 45° the two sections are latched together thus ensuring alignment of the water chamber splitters 7 two compartments, the clean water chamber 11 and the tablet holder chamber 4.

The handheld retractable cleaning sprayer will provide a single source for initial wetting, cleaning, and rinsing with a simple turning of the water selector knob 13, introducing water flow through the desired tablet holder chamber 4 through the nozzle output channel 9 and out the rotation nozzle 1 spray selector.

The user will be able to easily select the desired function via the 3-way ball valve assembly 5 which directs the source water either through the tablet holder housing 3 or, through the clean water chamber 11. The option for 'OFF' is also available.

Once the desired source required is selected (soap water or clear water), users manually rotate the rotation nozzle 1 for the appropriate spray for the object or objects to be cleaned.

Selections would include but are not restricted to—depending on the final configuration of the nozzle—stream, spray, mist, soak, etc. The spray selector would be from a current commercially available off-the-shelf product.

As shown in FIG. 3, the handheld retractable cleaning sprayer uniquely uses tablet(s) that are compressed solid products, designed to fit within the tablet holder chamber 4; making the handheld retractable cleaning sprayer capable of providing immediate application of the selected solution. There will be a variety of available tablets that have various cleaning solutions. The handheld retractable cleaning sprayer can be easily opened by way of a coupling 12 to lock the main nozzle body 2 to the 3-way ball valve assembly 5.

ITEMIZED NOMENCLATURE LIST

1—Rotation Nozzle
2—Main Nozzle Body
3—Tablet Holder Housing
4—Tablet holder Chamber
5—3-Way Ball Valve Assembly
6—Water Input Line Connector
7—Water Chamber Splitter
8—Tablet Chamber Water Output
9—Nozzle Water Output Channel
10—Nozzle Water Chamber Output
11—Clean Water Chamber
12—Coupling
13—Water Selector Knob
14—Source Water Input into Nozzle
15—Water Output to Nozzle
16—Coupling Alignment Stops
17—Gasket Slots
18—Gaskets
19—Coupling Quick Connect/Disconnect Receiving Slot
20—Coupling Quick Connect/Disconnect Alignment Pin
21—Left Blank
22—Water Input to Tablet Chamber
23—Tablet Chamber Screen
24—Ball Valve Water Output Nozzle

The invention claimed is:

1. A handheld retractable cleaning sprayer comprising:

a main nozzle body including a nozzle at one end and a water chamber splitter at an opposite end, the water chamber splitter consisting of a tablet holder chamber for containing a chemical tablet and a clean water chamber for clean water;

a three-way ball valve assembly including a selector knob, a water input line connector connecting to a hose at a first end and a coupling for removably connecting to the water chamber splitter at a second end;

wherein the water chamber splitter is controlled by the selector knob to select no water, clean water or chemical induced water, there is no water when the selector knob is in a first position, clean water flows through the clean water chamber when the selector knob is in a second position, and water flows through the table holder chamber to mix with the chemical tablet when the selector knob is a third position.

2. The handheld retractable cleaning sprayer according to claim 1, the coupling for attaching/detaching the three-way ball valve to/from the water chamber splitter is a quick disconnect/connect coupling using pins aligned to fit into a ball valve slots in the three-way ball valve allowing a 45 degrees twist to either connect or disconnect at the water chamber splitter and aligning the three-way ball valve with the chambers of the water chamber splitter.

3. The handheld retractable cleaning sprayer according to claim 1, when disconnecting the water chamber splitter from the three-way ball valve, a chemical tablet can be removed or inserted from the tablet holder chamber, wherein the tablet holder chamber further includes screens to hold the tablet in place.

4. The handheld retractable cleaning sprayer according to claim 1, the nozzle further includes a rotation nozzle manually rotated to provide different spray patterns.

* * * * *